US005528966A

United States Patent [19]

Coppejans

[11] Patent Number: 5,528,966

[45] Date of Patent: Jun. 25, 1996

[54] COMBO SCREW DRIVER HEAD

[76] Inventor: Mark G. Coppejans, 1105 Chalet Dr., E., Mobile, Ala. 36608

[21] Appl. No.: 450,824

[22] Filed: May 25, 1995

[51] Int. Cl.[6] ..... B25B 23/00

[52] U.S. Cl. ..... 81/460; 81/439

[58] Field of Search ..... 81/439, 460

[56] References Cited

U.S. PATENT DOCUMENTS 2,216,381 10/1940 West et al. .
2,389,129 11/1945 Bishop .
2,400,684 5/1946 Clark .
3,435,862 4/1969 Rainey .
4,328,721 5/1982 Massari .
4,488,462 12/1984 Wau .
4,867,018 9/1989 Spector .

*Primary Examiner*—James G. Smith

[57] ABSTRACT

The present invention describes a new and novel screwdriver head designed for use specifically with combo screws or uni-screws. The screwdriver head has a shank and a head having opposite mounted single straight ribs or blades of the type used on a standard flat-bladed screwdriver, and, perpendicular thereto, a pair of ribs of the Phillips headed screwdriver type. In between the pairs of ribs are recessed areas for connecting with the walls of the combo-screws.

3 Claims, 2 Drawing Sheets

COMBO SCREW DRIVER HEAD

BACKGROUND OF THE INVENTION

This invention generally relates to the field of screwdrivers, more particularly, the invention relates to a driver head or tip for combo screws or uni-screws, i.e., screws having a combination of single straight and Phillips-type shaped slots.

In U.S. Pat. No. 2,400,684, Clark, described an invention related to driving tools for threaded fasteners such as screws and the like having a driver recess of the Phillips-type modified by superimposing over one pair of the radial grooves of the recess a segmental diametrically disposed parallel kerf or groove terminating short of the periphery of the screwhead, somewhat shallower than the deeper portions of the recess and extending beyond the normal radial dimensions thereof. Such a recess being suitable for accommodating either a conventional flat-bladed screwdriver, a Phillips screwdriver, or the edge of a small coin when neither of the mentioned screwdrivers is available. The invention further described driving tools for threaded fasteners such as screws and the like, and more particularly to a tool for driving or securing, as well as unscrewing or removing, threaded elements having a modified Phillips-type driving recess. This invention was applicable only to screws with recessed or concave screwheads.

In U.S. Pat. No. 2,389,129, Bishop, described an invention related to screwdriving tools and more particularly to that type of such tool providing a screw-engaging bit comprising a plurality of radially extending ribs, usually three or four in number, formed by the provision of either fluted or sharply angled recesses intermediate said ribs, which tools are adapted for screwdriving cooperation with the screws provided with bits receiving recesses, corresponding in shape to the particular form of bit of the type mentioned. Again, this invention is designed for screws with recessed or concave heads.

In U.S. Pat. No. 2,216,381, West, et al., described an invention related to screws, and specifically to recessed head screws of the type adapted to be substituted in place of the familiar single-slotted screws.

In U.S. Pat. No. 3,435,862, Rainey, described a hand tool comprising a tube interconnected to a shaft for relative reciprocation along the rotation about the axis of the shaft. A tubular connecting member being rotably and reciprocally on the shaft and cooperating with a cam and shoulder surfaces of the tube and shaft, respectively, to rotate the tube when the shaft is rotated and to rotate the tube when a force is applied longitudinally of the shaft.

In U.S. Pat. No. 4,867,018, Spector, described an invention related to a screwdriver for alternative use with Phillips-head screws and slotted head screws comprising a handle and a shank extending therefrom, the leading end of the shank terminating in a Phillips-head screw engaging bit, the leading end portion of the shank is bifurcated by a rearwardly extending slot, and an elongated blade tipped with a slotted head screw bit is slidingly disposed along the slot. The blade is provided with a series of gear teeth along each edge and a nut is mounted around the shank for engagement with the blade teeth. The nut maintains the blade within the slot, and rotation of the nut controls the axial positioning of the blade to position either forwardly or rearwardly of the Phillips bit.

In U.S. Pat. No. 4,488,462, Wall, described a screwdriver provided for being used for installing and removing either single-slot screws or screws having two slots that cross at their centers, i.e., Phillips-type screws. A blade, suited for engagement in the slot of a single-slot screw, is slidably mounted in the tip segment slot. When the blade is in a first position extended beyond the end of the shaft tip segment, it can be engaged in a slot of a single-slot screw. When the blade is in a second position retracted or housed within the elongated tip segment slot, the tip segment can be engaged in the slots of such a cross-slotted screw.

In U.S. Pat. No. 4,328,721, Massari, described a device having a tubular shape having front and rear ends and including handle defining structure at its rear end and a Phillips head screw engaging tip on its front end. The tip is of the type including four equally peripherally spaced forwardly tapering and generally radially extending Phillips screwhead socket arm portion engaging lugs. A screwdriver blade is lengthwise glidingly reciprocally through a passage and includes a slotted screwhead engaging forward end projectible forwardly of the screwdriver tip and retractable rearwardly of at least the forward portion of the lugs of the tip. In this manner, the screwdriver may be utilized in conjunction with a Phillips head screw when the rectangular blade is in the retracted position and in conjunction with the slotted screwheads when the blade is in the extended position.

SUMMARY OF INVENTION

The present invention provides for a screwdriver tip, bit or head comprising a combination of a Phillips head and a standard single-slotted head screwdriver bit capable of cooperating with a screwhead having a combination of straight and Phillips-type slots, commonly referred to as a uni-screw or a combo screw in industry. The present design can be incorporated into a screwdriver or a power drill bit or a socket insert, in sizes that correspond to Phillips' bits numbers 1 through 4.

Throughout this specification the present invention will be referred to as a combo-bit taken form the term combo-screw.

The present invention, herein referred to as a combo-bit, is designed to be used with uni-screws or combo-screws found in numerous household items, e.g. cabinet hardware, ceiling fans, brackets and the like.

The present invention facilitates the installation of a combo screw or uni-screw because the combo-bit centers itself easily due to the protrusion of the Phillips flange of the bit into the Phillips slot in the combo screw. Therefore, the combo-bit remains in place in connection with the combo screw with less slippage during use because of the Phillips flange. Furthermore, the combo-bit has better torque transmitting characteristics because the standard blades fit into the straight slots of the combo screw. Another advantage of the combo-bit results because the standard Phillips screwdriver bit, when used in conjunction with a combo screw, does not accommodate a sufficient amount of torque for the screw to be fastened completely without mutilating the screwhead. Furthermore, the combo-bit is also superior to using a standard blade screwdriver because the Phillips flange of the bit keeps the combo-bit centered during use, while the straight blades of the combo-bit promote the required torque without mutilating or distorting the screwhead.

A Phillips head or a standard screwdriver blade can accommodate a combo screw, however, the combo-bit is more efficient because it is designed specifically for this screw by promoting greater torque with no slippage. It is not intended for the combo-bit to replace the Phillips or standard screwdriver bits. It is designed to be a convenient and efficient tool used for the installation of combo screws or uni-screws.

DETAILED DESCRIPTION OF THE PREFERRED EMBODIMENT(S)

Figure 1:
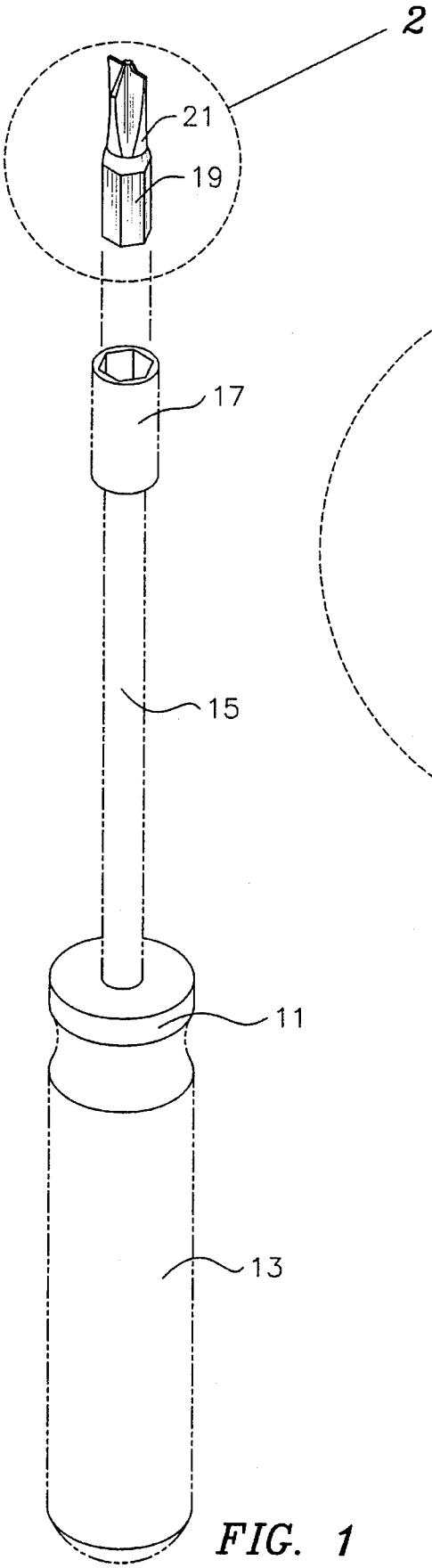
FIG. 1 is a perspective of the present invention shown in operative connection with a standard screwdriver handle and shaft having a socket type end.

Turning to FIG. 1, therein is generally shown a screwdriver assembly, (11), having a handle, (13), a shaft, (15), and a socket type head, (17). Shown in operative connection is the present invention showing its shank, (19), and the combo-bit head, (21). Note that while the present invention described in FIG. 1 can be manufactured as a socket for use with a screwdriver having a socket head, (17), that the present invention could be manufactured so that its shank, (19), would simply be manufactured as a unit or extension of the shaft, (15), of the screwdriver, thereby eliminating the need for the sockethead, (17), of the screwdriver shown in FIG. 1. The present invention could also be manufactured as a bit to be inserted into a power drill.

Figure 2:
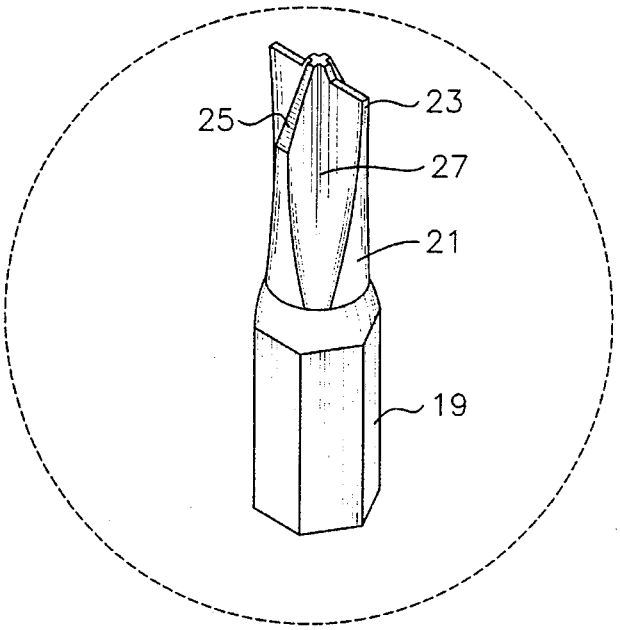
FIG. 2 is a perspective view of the present invention.

Turning to FIG. 2, therein is shown the present invention with its shank, (19), and the combo-bit generally being shown at 21. Furthermore, therein is shown the single straight, standard screwdriver type blade or rib, (23), the Phillips type blade or rib, (25), with a recess in between, (27). Note that there are two blades or ribs for the standard screwdriver blade, and two ribs or blades for the Phillips type blade with a total of four recesses.

Figure 3:
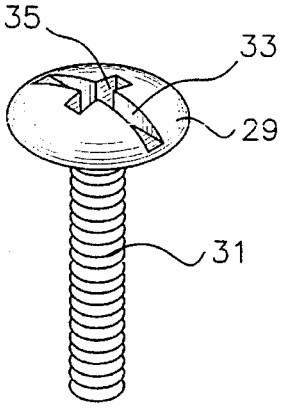
FIG. 3 is a perspective view of a combo screw.

Turning to FIG. 3, therein is shown a perspective view of a uni-screw or combo screw. Therein is shown the head of the combo screw, (29), with a threaded portion, (31), having a recessed portion to accommodate a standard type screwdriver head, (33), and a recessed portion to accommodate a Phillips type screwdriver head, (35).

Figure 4:
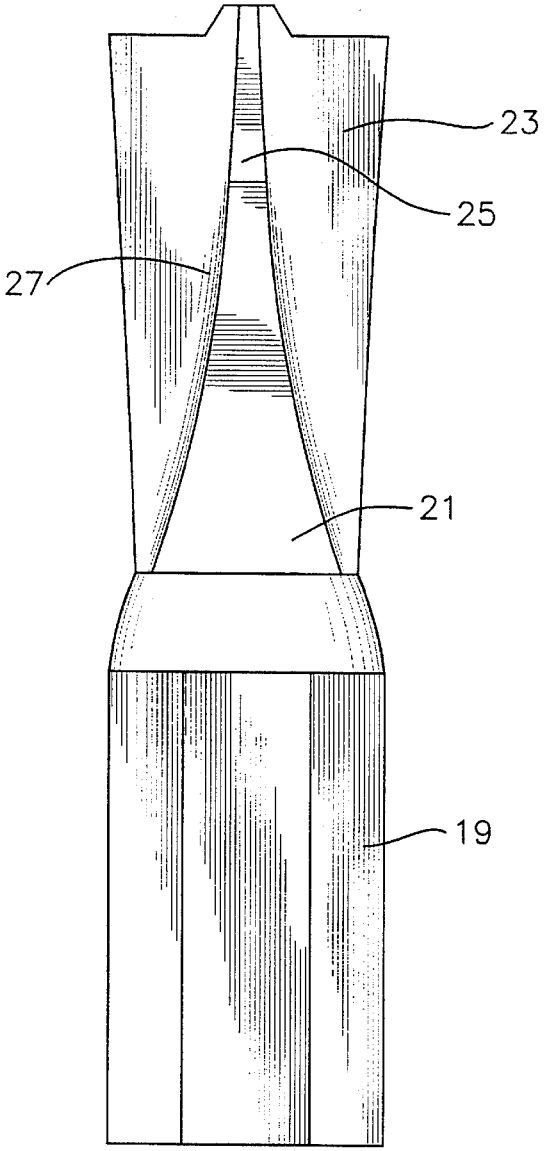
FIG. 4 is a elevation view showing blades corresponding to a standard type screwdriver of the present invention.

Turning to FIG. 4, therein is shown the present invention with its shank, (19), the head, (21), the standard screwdriver single blades or ribs, (23), the Phillips blade or rib, (25) and the recesses situated between, (27).

Figure 5:
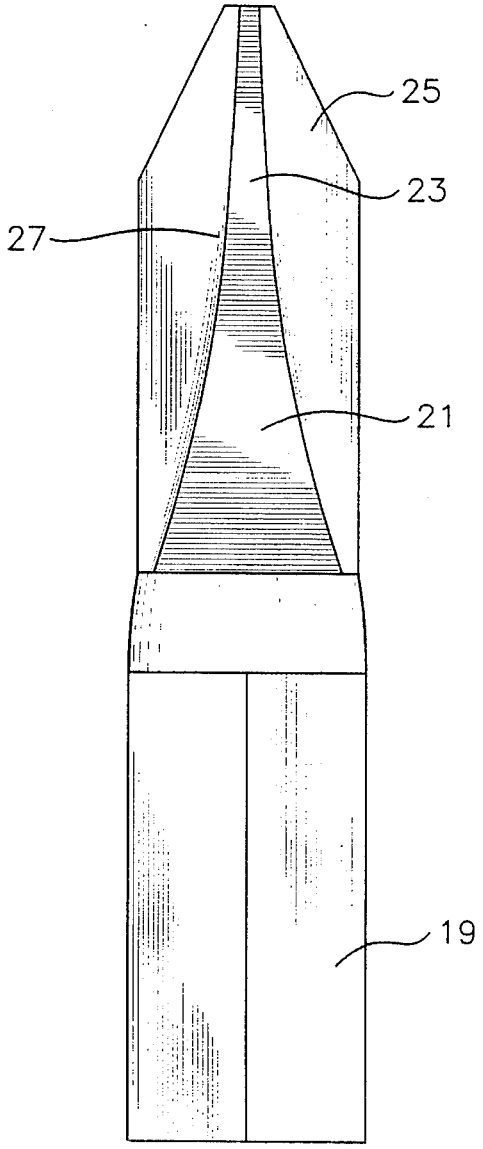
FIG. 5 is an elevation view showing the Phillips type head features of the present invention.

Turning to FIG. 5, therein is shown the present invention with its shank, (19), the head, (21), the standard blade or rib, (23), the Phillips blades or ribs, (25), and the recesses (27) between. It is believed that the Phillips blade or rib, (25), will be designed to have an angle inclined from the center of the axis of the head and/or shank, of 13°–33°, more particularly 19°–27°, and more particularly about 23°.

Figure 6:
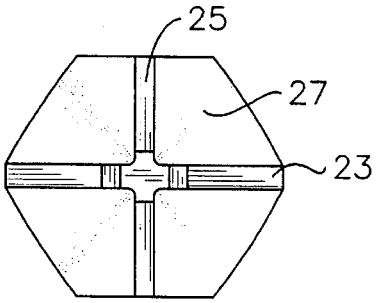
FIG. 6 is a plan view of the present invention.

Turning to FIG. 6, therein is shown the present invention with the standard screwdriver blades or ribs, (23), the Phillips blades or ribs, (25), and the recesses in between, (27).

I claim:

1. A screwdriver tip comprising:

(a) a shank;

(b) a head, said head being of such a length that no portion of said shank engages any portion of a combo screw;

(c) said head comprising a first pair of opposite facing straight ribs of the standard single-bladed screwdriver type;

(d) said head further comprising a second pair of opposite facing angular ribs of the Phillips type; and, (e) wherein said angular ribs make an angle inclined from the center of an axis of the head of 13°–33° whereby said head is suitable for cooperating with a combo screw such that the head alone supports the tip on the combo screw.

2. The tip of claim 1 wherein said angular ribs make an angle from the axis of the head of about 23°.

3. The tip of claim 1 wherein said angular ribs make an angle from the axis of the head of 19° to 27°.

* * * * *